US012152601B2

(12) United States Patent
Okano et al.

(10) Patent No.: US 12,152,601 B2
(45) Date of Patent: Nov. 26, 2024

(54) TURBO FLUID MACHINE

(71) Applicant: KABUSHIKI KAISHA TOYOTA JIDOSHOKKI, Aichi (JP)

(72) Inventors: Yuki Okano, Aichi (JP); Hiroshi Saito, Aichi (JP); Yuki Endo, Aichi (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 0 days.

(21) Appl. No.: 17/989,058

(22) Filed: Nov. 17, 2022

(65) Prior Publication Data

US 2023/0167829 A1 Jun. 1, 2023

(30) Foreign Application Priority Data

Nov. 30, 2021 (JP) ..... 2021-193795

(51) Int. Cl.
*F04D 17/12* (2006.01)
*F04D 17/10* (2006.01)
(Continued)

(52) U.S. Cl.
CPC ..... *F04D 29/4206* (2013.01); *F04D 17/10* (2013.01); *F04D 17/122* (2013.01);
(Continued)

(58) Field of Classification Search
CPC ..... F04D 17/12; F04D 17/122; F04D 17/125; F04D 29/4206; F04D 29/083; F04D 29/403; F04D 1/063; F04D 1/066
See application file for complete search history.

(56) References Cited

U.S. PATENT DOCUMENTS 2,888,193 A * 5/1959 Greenwald ..... F25B 1/053 415/199.1
3,976,395 A * 8/1976 Kalnin ..... F04D 17/125 415/230
(Continued)

FOREIGN PATENT DOCUMENTS

EP 2837791 2/2015
JP 2-23299 1/1990
(Continued)

OTHER PUBLICATIONS

Office Action issued in Corresponding JP Patent Application No. 2021-193795, dated Aug. 6, 2024, along with an English translation thereof.

*Primary Examiner* — Brian P Wolcott
*Assistant Examiner* — Behnoush Haghighian
(74) *Attorney, Agent, or Firm* — Greenblum & Bernstein, P.L.C.

(57) ABSTRACT

A turbo fluid machine includes: a housing including an impeller chamber and a motor chamber accommodating an electric motor; an impeller that is accommodated in the impeller chamber and compresses fluid by the electric motor; a drive shaft extending in an axial direction of the drive shaft to connect the impeller and the electric motor; and a gasket sealing between the impeller chamber and an outside of the housing. The housing includes a first housing and a second housing that form the impeller chamber. The first housing and the second housing are arranged in the axial direction. The gasket is disposed between the first housing and the second housing in the axial direction. The first housing and the second housing are in contact with each other in the axial direction on at least one of an outer circumferential side and an inner circumferential side of the gasket.

5 Claims, 7 Drawing Sheets

(51) Int. Cl.

| | |
|---|---|
| ***F04D 29/08*** | (2006.01) |
| ***F04D 29/42*** | (2006.01) |
| *F04D 25/06* | (2006.01) |
| *F04D 29/58* | (2006.01) |

(52) U.S. Cl.
CPC ..... *F04D 29/083* (2013.01); *F04D 25/06* (2013.01); *F04D 29/5806* (2013.01)

(56) References Cited

U.S. PATENT DOCUMENTS 5,795,138 A * 8/1998 Gozdawa ..... F04D 29/5826 417/423.12
6,698,929 B2 * 3/2004 Choi ..... F01D 25/166 417/247
6,722,666 B2 4/2004 Yokomachi et al.
7,704,056 B2 * 4/2010 Masoudipour ..... F04D 25/0606 62/505
8,562,314 B2 * 10/2013 Hong ..... F04D 13/064 417/423.1
8,925,197 B2 * 1/2015 Royal ..... F04D 29/057 29/888.024
9,303,655 B2 * 4/2016 Griffin ..... F04D 17/122
9,371,835 B2 * 6/2016 Stanko ..... F04D 25/06
9,732,766 B2 * 8/2017 Thompson ..... F04D 29/056
9,897,091 B2 * 2/2018 Hoshino ..... H02K 9/12
10,364,761 B2 * 7/2019 Sivaraman ..... F02B 33/40
10,364,820 B1 * 7/2019 Oda ..... F04D 29/622
10,514,041 B2 * 12/2019 Fujii ..... F16C 27/02
10,527,062 B2 * 1/2020 Yanagisawa ..... F04D 17/125
10,570,908 B2 * 2/2020 Gu ..... F16C 32/0618
10,605,251 B2 * 3/2020 Oh ..... F04D 27/002
11,221,012 B2 * 1/2022 Mori ..... F04D 25/024
11,261,879 B2 * 3/2022 Akamatsu ..... F04D 29/053
11,655,827 B2 * 5/2023 Kato ..... F04D 17/08 415/203
2008/0199326 A1 * 8/2008 Masoudipour ..... F04D 29/0513 417/247
2008/0226387 A1 9/2008 Namiki
2009/0044548 A1 * 2/2009 Masoudipour ..... F25B 1/04 62/505
2012/0148391 A1 * 6/2012 Ibaraki ..... F04D 29/4206 415/200
2013/0318797 A1 * 12/2013 Royal ..... F04D 27/02 29/898.041
2015/0016988 A1 * 1/2015 Griffin ..... F04D 29/162 415/214.1
2015/0267709 A1 * 9/2015 Hoshino ..... F04D 17/10 415/199.4
2015/0267717 A1 * 9/2015 Fujii ..... F04D 29/057 415/220
2019/0055954 A1 * 2/2019 Egawa ..... F04D 29/057
2019/0226393 A1 * 7/2019 Arakawa ..... F02B 39/08
2020/0235616 A1 * 7/2020 Suzuki ..... H02K 3/24
2020/0263698 A1 * 8/2020 Mori ..... F04D 25/024
2021/0310371 A1 * 10/2021 Spathias ..... F01D 5/143
2021/0324875 A1 * 10/2021 Kato ..... F04D 25/0606
2023/0117537 A1 * 4/2023 Hirano ..... F04D 29/582 417/423.1
2023/0258200 A1 * 8/2023 Umeyama ..... F04D 29/441 417/423.14
2023/0304706 A1 * 9/2023 Moon ..... F04D 17/122

FOREIGN PATENT DOCUMENTS

| | | |
|---|---|---|
| JP | 2002-317764 | 10/2002 |
| JP | 4021232 | 12/2007 |
| JP | 2009-281277 | 12/2009 |
| JP | 6035890 | 11/2016 |
| WO | 2006/068014 | 6/2006 |

* cited by examiner

TURBO FLUID MACHINE

CROSS-REFERENCE TO RELATED APPLICATION

This application claims priority to Japanese Patent Application No. 2021-193795 filed on Nov. 30, 2021, the entire disclosure of which is incorporated herein by reference.

BACKGROUND ART

The present disclosure relates to a turbo fluid machine.

Japanese Patent Application Publication No. 2009-281277 discloses a conventional turbo fluid machine. The turbo fluid machine includes a housing, an impeller, and a drive shaft. The housing includes an impeller chamber and a motor chamber. The motor chamber accommodates an electric motor. The impeller chamber accommodates the impeller. The impeller compresses fluid with rotation of the electric motor. The housing accommodates the drive shaft. The drive shaft extends in its axial direction and connects the impeller and the electric motor. In Japanese Patent Application Publication No. 2009-281277, the fluid is refrigerant.

The housing includes a first housing and a second housing. The first housing and the second housing are disposed in the axial direction of the drive shaft. Thus, the impeller chamber is formed between the first housing and the second housing.

An O-ring is provided between the first housing and the second housing. Specifically, the O-ring is provided at a position on an inner circumferential side of the first housing and on an outer circumferential side of the second housing in a radial direction of the housing.

In the above-described turbo fluid machine, the O-ring is held between the first housing and the second housing, and elastically deformed in the radial direction of the housing. Thus, the O-ring is in contact with the first housing and the second housing and seals between the impeller chamber and an outside of the housing.

This kind of turbo fluid machine needs to be downsized in order that the turbo fluid machine is easily mounted on a vehicle or the like, while leakage of high-pressure fluid in the impeller chamber to the outside of the housing is prevented. However, in this kind of turbo fluid machine, a clearance is required for disposing the O-ring between the first housing and the second housing in the radial direction of the housing. Thus, it is difficult to downsize the turbo fluid machine in the radial direction. As a result, it is difficult to downsize further the turbo fluid machine.

Then, instead of the O-ring, a gasket may be provided between the first housing and the second housing. However, a clearance for the gasket needs to be suitably formed between the first housing and the second housing, in order that the gasket suitably seals between the impeller chamber and the outside of the housing. Therefore, manufacture of a turbo fluid machine with the above-described configuration is more difficult, which increases a cost of the manufacture of the turbo fluid machine.

The present disclosure, which has been made in light of the above-mentioned problem, is directed to providing a turbo fluid machine configured to achieve downsizing and reduction of a manufacturing cost of the turbo fluid machine while leakage of fluid from an impeller chamber to an outside of the housing is suitably prevented.

SUMMARY

In accordance with an aspect of the present disclosure, there is provided a turbo fluid machine that includes: a turbo fluid machine includes: a housing including an impeller chamber and a motor chamber accommodating an electric motor; an impeller that is accommodated in the impeller chamber and compresses fluid by the electric motor being rotated; a drive shaft that is accommodated in the housing and extends in an axial direction of the drive shaft to connect the impeller and the electric motor; and a gasket that is made of metal and seals between the impeller chamber and an outside of the housing. The housing includes a first housing and a second housing that form the impeller chamber. The first housing and the second housing are arranged in the axial direction. The gasket is disposed between the first housing and the second housing in the axial direction. The first housing and the second housing are in contact with each other in the axial direction on at least one of an outer circumferential side and an inner circumferential side of the gasket.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe a first embodiment, a second embodiment, and a modification of the present disclosure with reference to the drawings. A turbo fluid machine of each of the first embodiment, the second embodiment, and the modification is mounted on a vehicle (not illustrated) and used for a refrigeration cycle of a vehicle air conditioner.

First Embodiment

Figure 1:
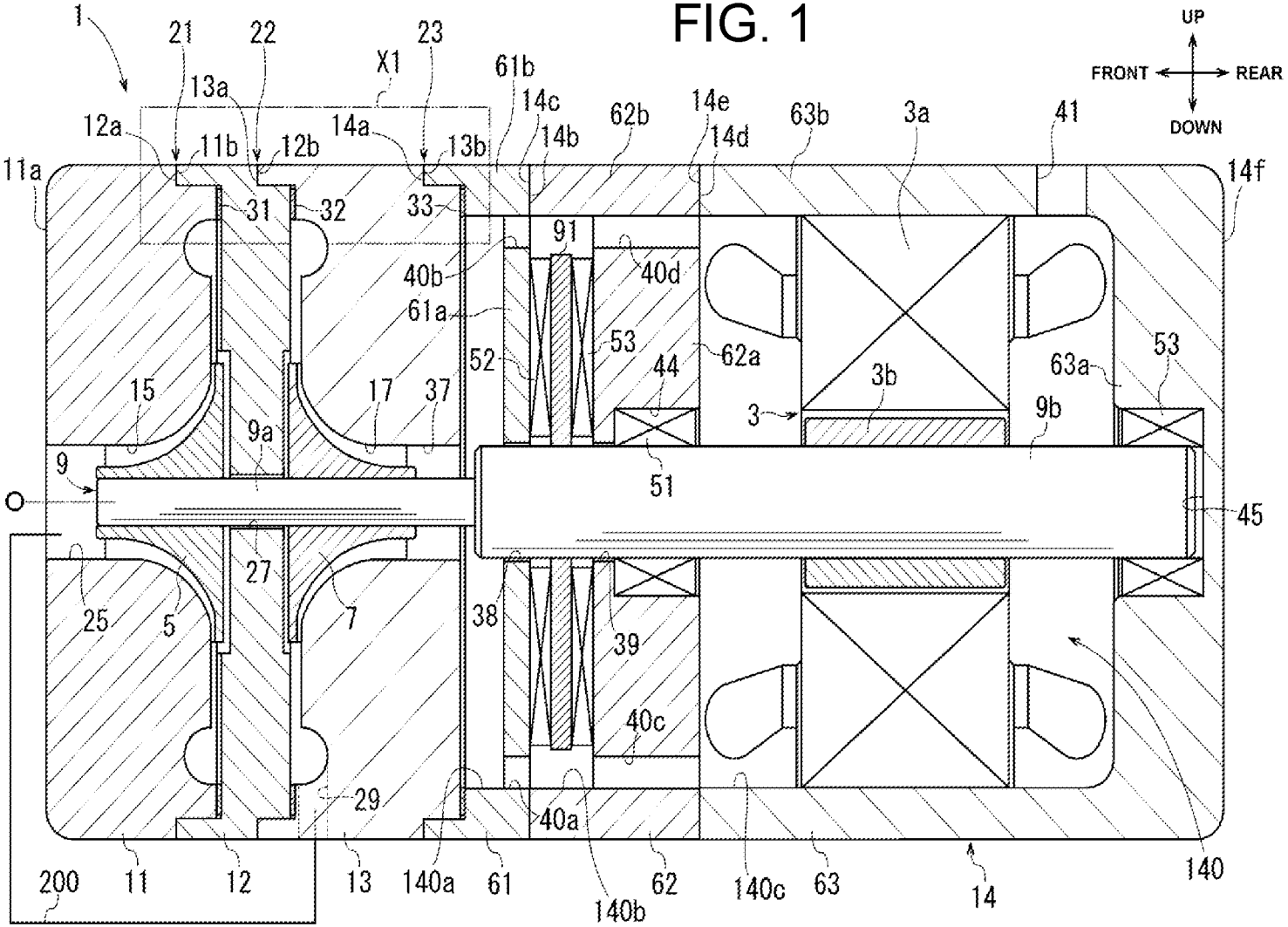
FIG. 1 is a cross-sectional view of a turbo fluid machine according to a first embodiment.

As illustrated in FIG. 1, the turbo fluid machine of the first embodiment includes a housing 1, an electric motor 3, a first impeller 5, a second impeller 7, a drive shaft 9, a first gasket 31, a second gasket 32, and a third gasket 33. The housing 1 includes a first housing 11, a second housing 12, a third housing 13, and a fourth housing 14.

In the present embodiment, a front-rear direction and an up-down direction of the turbo fluid machine are indicated by solid arrows illustrated in FIG. 1. The front-rear direction is an example of "an axial direction of a drive shaft" of the present disclosure. Terms of "forward" and "rearward" in the present disclosure correspond to directions in the front-rear direction of the turbo fluid machine. The front-rear direction and the up-down direction of the turbo fluid machine in FIG. 1 are also applied to FIG. 2 to FIG. 10. An orientation of the turbo fluid machine may be appropriately changed depending on a vehicle on which the turbo fluid machine is mounted.

The first housing 11, the second housing 12, the third housing 13, and the fourth housing 14 included in the housing 1 are made of metal such as aluminum alloy. The first housing 11, the second housing 12, the third housing 13, and the fourth housing 14 are arranged in this order in the front-rear direction. Thus, the first housing 11 forms a front part of the housing 1, and the fourth housing 14 forms a rear part of the housing 1.

The fourth housing 14 includes a first block 61, a second block 62, and a third block 63. The first block 61, the second block 62, and the third block 63 are arranged in this order in the front-rear direction. Thus, the first block 61 is disposed at the front most position of the fourth housing 14.

The first housing 11 includes a first front end surface 11*a* and a first rear end surface 11*b*. The first front end surface 11*a* is positioned at a front end of the first housing 11. Thus, the first front end surface 11*a* forms a front end surface of the housing 1. The first rear end surface 11*b* is positioned at a rear end of the first housing 11.

Similarly, the second housing 12 includes a second front end surface 12*a* and a second rear end surface 12*b*. The third housing 13 includes a third front end surface 13*a* and a third rear end surface 13*b*. The second front end surface 12*a* is positioned at a front end of the second housing 12, and the third front end surface 13*a* is positioned at a front end of the third housing 13. The second rear end surface 12*b* is positioned at a rear end of the second housing 12, and the third rear end surface 13*b* is positioned at a rear end of the third housing 13.

In the fourth housing 14, the first block 61 includes a fourth front end surface 14*a* and a fourth rear end surface 14*b*. The second block 62 includes a fifth front end surface 14*c* and a fifth rear end surface 14*d*. The third block 63 includes a sixth front end surface 14*e* and a sixth rear end surface 14*f*. The fourth front end surface 14*a* is positioned at a front end of the first block 61, the fifth front end surface 14*c* is positioned at a front end of the second block 62, and the sixth front end surface 14*e* is positioned at a front end of the third block 63. The fourth rear end surface 14*b* is positioned at a rear end of the first block 61, the fifth rear end surface 14*d* is positioned at a rear end of the second block 62, and the sixth rear end surface 14*f* is positioned at a rear end of the third block 63. That is, the fourth front end surface 14*a* forms a front end surface of the fourth housing 14, and the sixth rear end surface 14*f* forms a rear end surface of the fourth housing 14.

Figure 2:
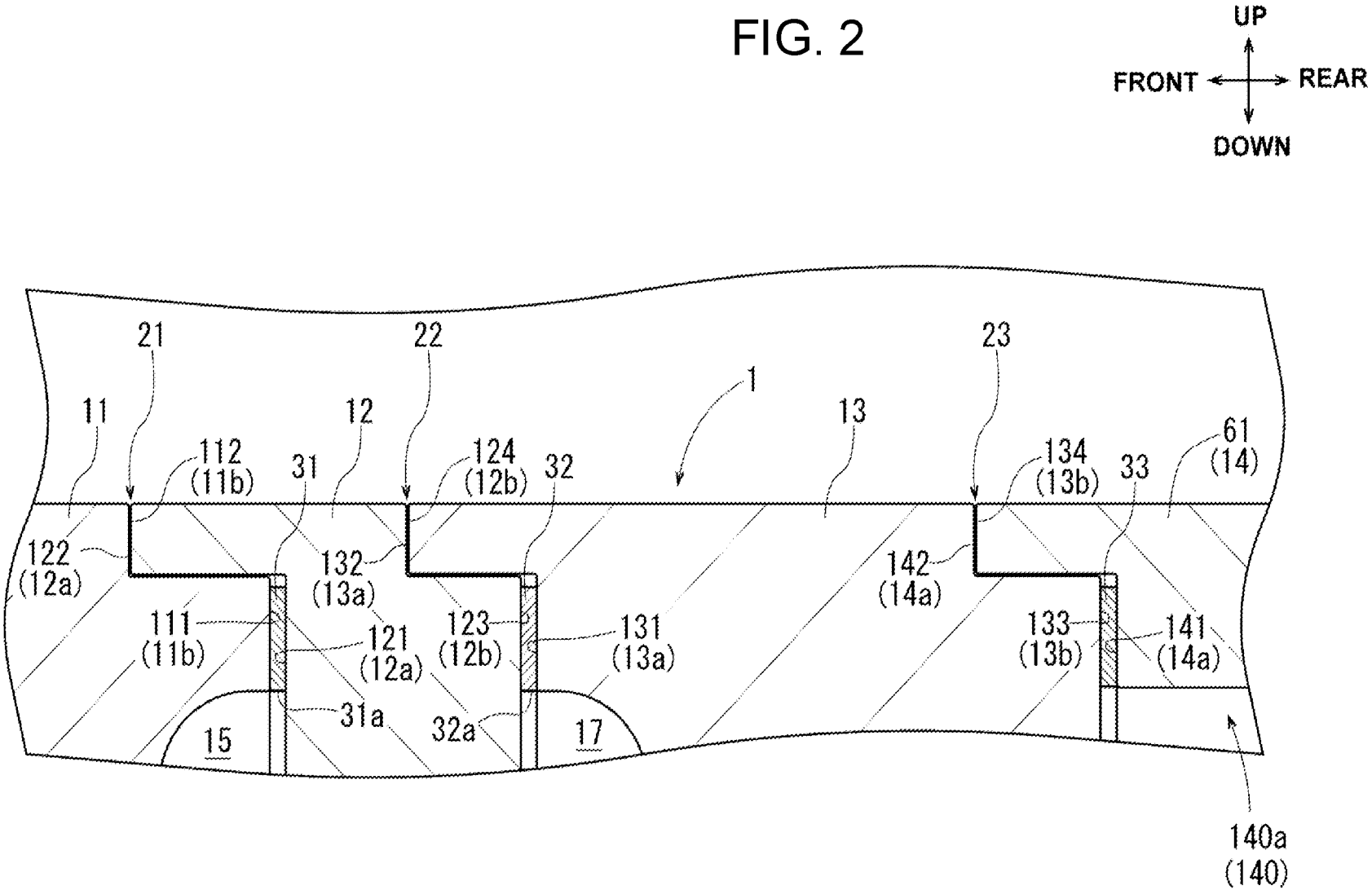
FIG. 2 is an enlarged cross-sectional view of a main part of the turbo fluid machine according to the first embodiment, illustrating X1 in FIG. 1.

As illustrated in FIG. 2, the second housing 12 is disposed behind the first housing 11, so that the first rear end surface 11*b* faces the second front end surface 12*a* in the front-rear direction. As illustrated in FIG. 1, a first impeller chamber 15 is formed between the first housing 11 and the second housing 12.

As illustrated in FIG. 2, the third housing 13 is disposed behind the second housing 12, so that the second rear end surface 12*b* faces the third front end surface 13*a* in the front-rear direction. As illustrated in FIG. 1, a second impeller chamber 17 is formed between the second housing 12 and the third housing 13. A first block 61 is disposed behind the third housing 13, so that the third rear end surface 13*b* faces the fourth front end surface 14*a* in the front-rear direction.

As illustrated in FIG. 2, a first division portion 21 corresponds to a boundary portion between the first housing 11 and the second housing 12 that is a boundary portion between the first rear end surface 11*b* and the second front end surface 12*a*. A second division portion 22 corresponds to a boundary portion between the second housing 12 and the third housing 13 that is a boundary portion between the second rear end surface 12*b* and the third front end surface 13*a*.

A third division portion 23 corresponds to a boundary portion between the third housing 13 and the first block 61 that is a boundary portion between the third rear end surface 13*b* and the fourth front end surface 14*a*.

The first division portion 21 is disposed at the most front position, and the third division portion 23 is disposed at the most rear position among the first to third division portions 21 to 23. The second division portion 22 is disposed between the first division portion 21 and the third division portion 23 in the front-rear direction. Thus, the first rear end surface 11*b* is positioned in a front part of the first division portion 21, and the second front end surface 12*a* is positioned in a rear part of the first division portion 21. The second rear end surface 12*b* is positioned in a front part of the second division portion 22, and the third front end surface 13*a* is positioned in a rear part of the second division portion 22. The third rear end surface 13*b* is positioned in a front part of the third division portion 23, and the fourth front end surface 14*a* is positioned in a rear part of the third division portion 23.

A first gasket 31 is disposed in the first division portion 21. A second gasket 32 is disposed in the second division portion 22. A third gasket 33 is disposed in the third division portion 23. The first gasket 31, the second gasket 32, and the third gasket 33 will be described later in detail.

Here, the first rear end surface 11*b* includes a first rear-side main body portion 111 facing the first gasket 31 and a first rear-side outer circumferential portion 112 positioned on an outer circumference of the first rear-side main body portion 111. A front part of the first impeller chamber 15 is formed at the first rear-side main body portion 111.

The second front end surface 12*a* includes a second front-side main body portion 121 facing the first gasket 31 and a second front-side outer circumferential portion 122 disposed on an outer circumference of the second front-side main body portion 121. A rear part of the first impeller chamber 15 is formed at the second front-side main body portion 121. The second rear end surface 12*b* includes a second rear-side main body portion 123 facing the second gasket 32 and a second rear-side outer circumferential portion 124 disposed on an outer circumference of the second rear-side main body portion 123. A front part of the second impeller chamber 17 is formed at the second rear-side main body portion 123.

Figure 3:
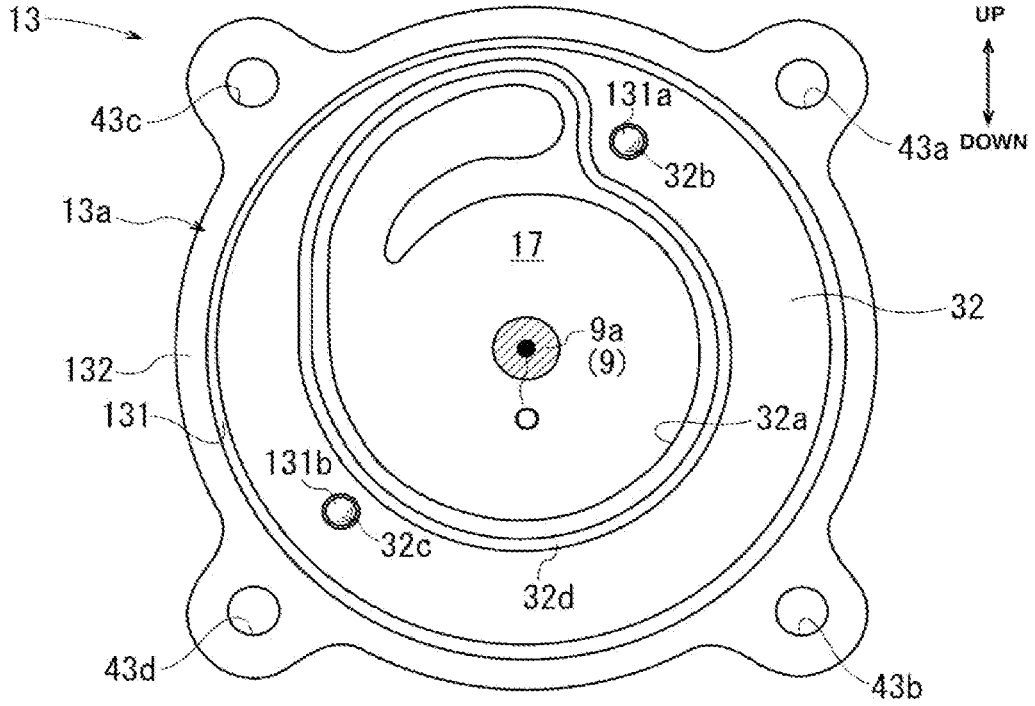
FIG. 3 is a front view of the turbo fluid machine as seen from a front according to the first embodiment, illustrating a third housing and a second gasket.

As illustrated in FIG. 3, the third front end surface 13*a* includes a third front-side main body portion 131 facing the second gasket 32 and a third front-side outer circumferential portion 132 disposed on an outer circumference of the third front-side main body portion 131. A rear part of the second impeller chamber 17, and a first positioning protrusion 131*a* and a second positioning protrusion 131*b* are formed at the third front-side main body portion 131. The first positioning protrusion 131*a* and the second positioning protrusion 131*b* each have a substantially hemispherical shape and protrude forward from the third front-side main body portion 131.

As illustrated in FIG. 2, the third rear end surface 13*b* includes a third rear-side main body portion 133 facing the third gasket 33 and a third rear-side outer circumferential portion 134 disposed on an outer circumference of the third rear-side main body portion 133.

Figure 4:
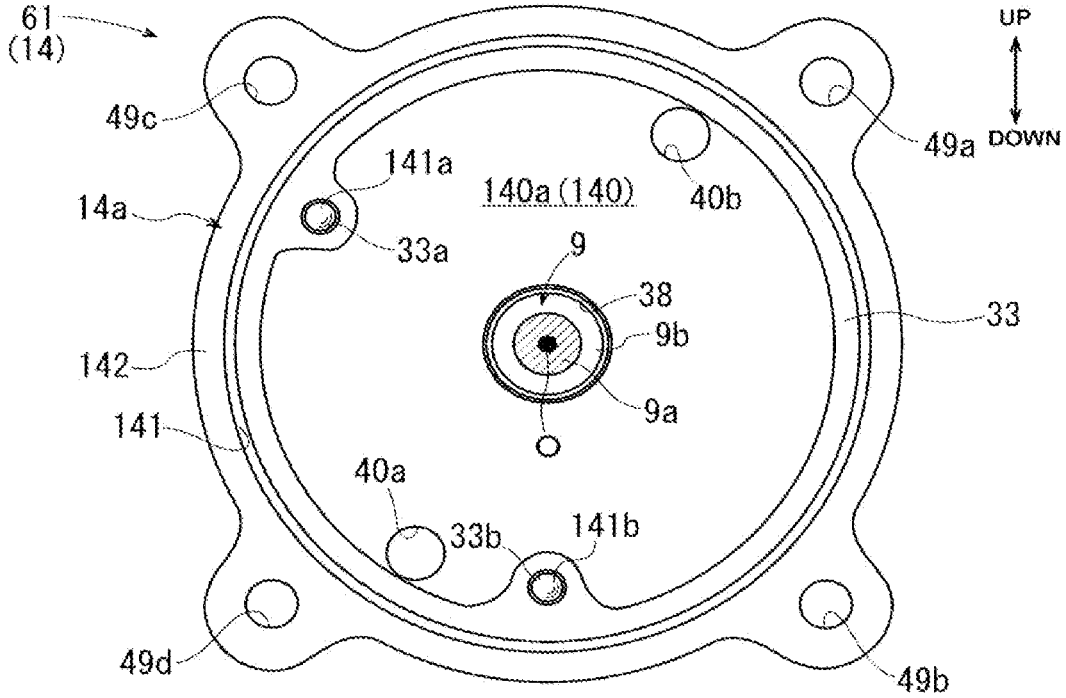
FIG. 4 is a front view of the turbo fluid machine as seen from the front according to the first embodiment, illustrating a fourth housing and a third gasket.

As illustrated in FIG. 4, the fourth front end surface 14*a* includes a fourth front-side main body portion 141 facing the third gasket 33 and a fourth front-side outer circumferential portion 142 disposed on an outer circumference of the fourth front-side main body portion 141. The fourth front-side main body portion 141 includes a third positioning protrusion 141*a* and a fourth positioning protrusion 141*b*. The third positioning protrusion 141*a* and the fourth positioning protrusion 141*b* each have a substantially hemispherical shape and protrude forward from the fourth front-side main body portion 141. The first positioning protrusion 131*a*, the second positioning protrusion 131*b*, the third positioning protrusion 141*a*, and the fourth positioning protrusion 141*b* may have any shape and number as appropriate.

As illustrated in FIG. 2, the first rear-side outer circumferential portion 112 is a part of the first rear end surface 11*b* recessed forward relative to the first rear-side main body portion 111, the second rear-side outer circumferential portion 124 is a part of the second rear end surface 12*b* recessed forward relative to the second rear-side main body portion 123, and the third rear-side outer circumferential portion 134 is a part of the third rear end surface 13*b* recessed forward relative to the third rear-side main body portion 133. On the other hand, the second front-side outer circumferential portion 122 is a part of the second front end surface 12*a* protruding forward relative to the second front-side main body portion 121, the third front-side outer circumferential portion 132 is a part of the third front end surface 13*a* protruding forward relative to the third front-side main body portion 131, and the fourth front-side outer circumferential portion 142 is a part of the fourth front end surface 14*a* protruding forward relative to the fourth front-side main body portion 141. As a result, the first division portion 21, the second division portion 22, and the third division portion 23 are each bent forward on the outer circumferential side thereof, without planarly extending in a radial direction of the housing 1, to have a stepped shape.

The first housing 11, the second housing 12, the third housing 13, and the fourth housing 14 are fastened to each other in the front-rear direction with a first fastening bolt 19*a*, a second fastening bolt 19*b*, a third fastening bolt 19*c*, and a fourth fastening bolt 19*d* (see FIG. 5 and FIG. 6) while accommodating the electric motor 3, the drive shaft 9, the first impeller 5, the second impeller 7, and the like and accommodating the first gasket 31, the second gasket 32, and the third gasket 33 disposed in the first division portion 21, the second division portion 22, and the third division portion 23, respectively. As a result, the first housing 11, the second housing 12, the third housing 13, and the fourth housing 14 are assembled integrally with the first gasket 31, the second gasket 32, and the third gasket 33, as illustrated in FIG. 1. FIG. 1, FIG. 2, and FIG. 7 (which will be described later) do not illustrate the first to fourth fastening bolts 19*a* to 19*d* for convenience of the explanation.

As described above, the first housing 11, the second housing 12, the third housing 13, and the fourth housing 14 are assembled with the first gasket 31, the second gasket 32, and the third gasket 33 with the fastening bolts 19*a* to 19*d*, so that the front part of the first impeller chamber 15 formed in the first rear-side main body portion 111 and the rear part of the first impeller chamber 15 formed in the second front-side main body portion 121 are joined to each other in the front-rear direction. The front part of the second impeller chamber 17 formed in the second rear-side main body portion 123 and the rear part of the second impeller chamber 17 formed in the third front-side main body portion 131 are joined to each other in the front-rear direction. Thus, the first impeller chamber 15 is formed by the first housing 11 and the second housing 12 and accommodated inside the first housing 11 and the second housing 12, as illustrated in FIG. 1. The second impeller chamber 17 is formed by the second housing 12 and the third housing 13 and accommodated inside the second housing 12 and the third housing 13.

The first housing 11 has a second inlet 25. The second inlet 25 is positioned at a central portion of the first housing 11 and extends inside the first housing 11 in the front-rear direction. A rear end of the second inlet 25 is connected to the first impeller chamber 15. A front end of the second inlet 25 communicates with an outside of the first housing 11, that is, an outside of the housing 1. The first housing 11 has a second outlet (not illustrated) through which the first impeller chamber 15 communicates with the outside of the housing 1.

The second housing 12 has a first axial hole 27. The first axial hole 27 is positioned at a central portion of the second housing 12. The first axial hole 27 is formed coaxially with the second inlet 25 and extends inside the second housing 12 in the front-rear direction. A front end of the first axial hole 27 is connected to the first impeller chamber 15, and a rear end of the first axial hole 27 is connected to the second impeller chamber 17.

The third housing 13 has a second axial hole 37. The second axial hole 37 is positioned at a central portion of the third housing 13. The second axial hole 37 is formed coaxially with the second inlet 25 and the first axial hole 27, and extends inside the third housing 13 in the front-rear direction. A diameter of the second axial hole 37 is larger than that of the first axial hole 27, and a front end of the second axial hole 37 is connected to the second impeller chamber 17. A rear end of the second axial hole 37 is opened at a rear end of the third housing 13.

Figure 5:
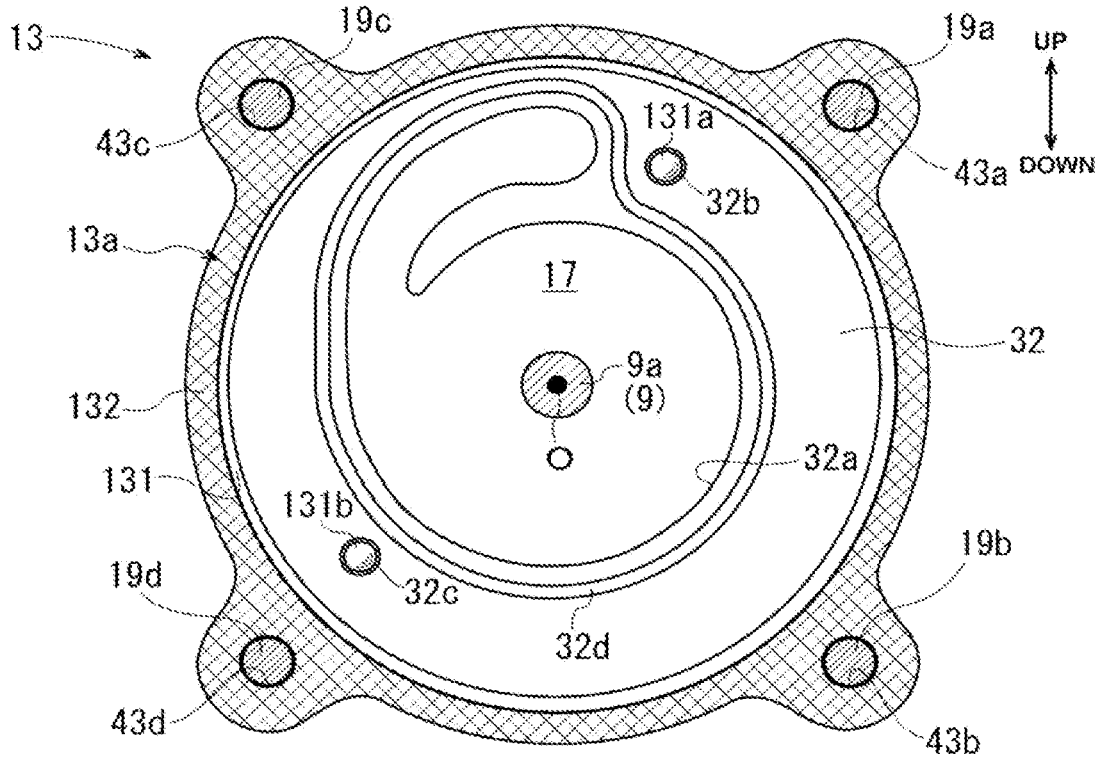
FIG. 5 is a front view of the turbo fluid machine according to the first embodiment, illustrating a contact portion and the like of the third housing being in contact with the second housing.

As illustrated in FIG. 3 and FIG. 5, the third housing 13 has an insertion hole 43*a* into which the first fastening bolt 19*a* is inserted, an insertion hole 43*b* into which the second fastening bolt 19*b* is inserted, an insertion hole 43*c* into which the third fastening bolt 19*c* is inserted, and an insertion hole 43*d* into which the fourth fastening bolt 19*d* is inserted. The insertion holes 43*a* to 43*d* extend from the third front end surface 13*a* to the third rear end surface 13*b*, specifically, from the third front-side outer circumferential portion 132 to the third rear-side outer circumferential portion 134.

As illustrated in FIG. 1, the third housing 13 has a first outlet 29 through which the second impeller chamber 17 communicates with the outside of the housing 1. The first outlet 29 is connected to the second inlet 25 through a piping 200.

The first block 61 includes a first bottom wall 61*a* and a first peripheral wall 61*b*. The first bottom wall 61*a* is positioned at a rear end of the first block 61 and extends in the radial direction of the housing 1. A third axial hole 38 is formed at a central portion of the first bottom wall 61*a*. The third axial hole 38 is formed coaxially with the second axial hole 37, and extends through the first bottom wall 61*a* in the front-rear direction. The first bottom wall 61*a* has a first communication hole 40*a* and a second communication hole 40*b*. A diameter of each of the first communication hole 40*a* and the second communication hole 40*b* is smaller than that of the third axial hole 38. The first communication hole 40*a* and the second communication hole 40*b* each extend through the first bottom wall 61*a* in the front-rear direction.

The first peripheral wall 61*b* is connected to an outer circumference of the first bottom wall 61*a*, and extends forward from the first bottom wall 61*a*.

The first bottom wall 61*a* and the first peripheral wall 61*b* define the first block 61 that extends in the front-rear direction and has a bottomed tubular shape. The first block 61 includes a first motor chamber 140*a* formed between the first block 61 and the third housing 13. The first motor chamber 140*a* communicates with the second axial hole 37.

The second block 62 includes a second bottom wall 62*a* and a second peripheral wall 62*b*. The second bottom wall 62*a* is positioned at a rear end of the second block 62 and extends in the radial direction of the housing 1. A fourth axial hole 39 is formed at a central portion of the second bottom wall 62*a*. The fourth axial hole 39 is formed coaxially with the third axial hole 38, and extends through the second bottom wall 62*a* in the front-rear direction.

The second bottom wall 62*a* has a third communication hole 40*c*, a fourth communication hole 40*d*, and a first accommodation portion 44. A diameter of each of the third communication hole 40*c* and the fourth communication hole 40*d* is smaller than that of the fourth axial hole 39. The third communication hole 40*c* and the fourth communication hole 40*d* extend through the second bottom wall 62*a* in the front-rear direction. The first accommodation portion 44 is positioned at a central portion of the second bottom wall 62*a*, and recessed forward from a rear end of the second bottom wall 62*a*. The first accommodation portion 44 whose diameter is larger than that of the fourth axial hole 39 communicates with the fourth axial hole 39. A first radial bearing 51 is provided inside the first accommodation portion 44.

The second peripheral wall 62*b* is connected to an outer circumference of the second bottom wall 62*a* and extends forward from the second bottom wall 62*a*.

The second bottom wall 62*a* and the second peripheral wall 62*b* define the second block 62 that extends in the front-rear direction and has a bottomed tubular shape. The second block 62 forms a second motor chamber 140*b* at a position between the second block 62 and the first block 61. A first thrust bearing 52 and a second thrust bearing 53 are provided inside the second motor chamber 140*b*.

The third block 63 includes a third bottom wall 63*a* and a third peripheral wall 63*b*. The third bottom wall 63*a* is positioned at a rear end of the third block 63 and thus at a rear end of the fourth housing 14, and extends in the radial direction of the housing 1. A second accommodation portion 45 is formed in the third bottom wall 63*a*. The second accommodation portion 45 is positioned at a central portion of the third bottom wall 63*a*. The second accommodation portion 45 is formed coaxially with the third axial hole 38 and the fourth axial hole 39, and recessed rearward from a front end of the third bottom wall 63*a*. A second radial bearing 54 is provided inside the second accommodation portion 45.

The third peripheral wall 63*b* is connected to an outer circumference of the third bottom wall 63*a*, and extends forward from the third bottom wall 63*a*. The third peripheral wall 63*b* has a first inlet 41. The first inlet 41 extends through the third peripheral wall 63*b* in the radial direction of the housing 1.

The third bottom wall 63*a* and the third peripheral wall 63*b* define the third block 63 that extends in the front-rear direction and has a bottomed tubular shape.

The third block 63 forms a third motor chamber 140*c* at a position between the third block 63 and the second block 62.

The first to third motor chambers 140*a* to 140*c* communicate with each other through the first to fourth communication holes 40*a* to 40*d*. As a result, the first to third motor chambers 140*a* to 140*c* form the motor chamber 140. The motor chamber 140 communicates with the second axial hole 37 through the first motor chamber 140*a*.

The third motor chamber 140*c* of the motor chamber 140 communicates with the outside of the housing 1 through the first inlet 41. Thus, refrigerant gas is drawn from the outside of the housing 1 into the motor chamber 140 through the first inlet 41. The refrigerant gas is an example of "fluid" of the present disclosure.

Figure 6:
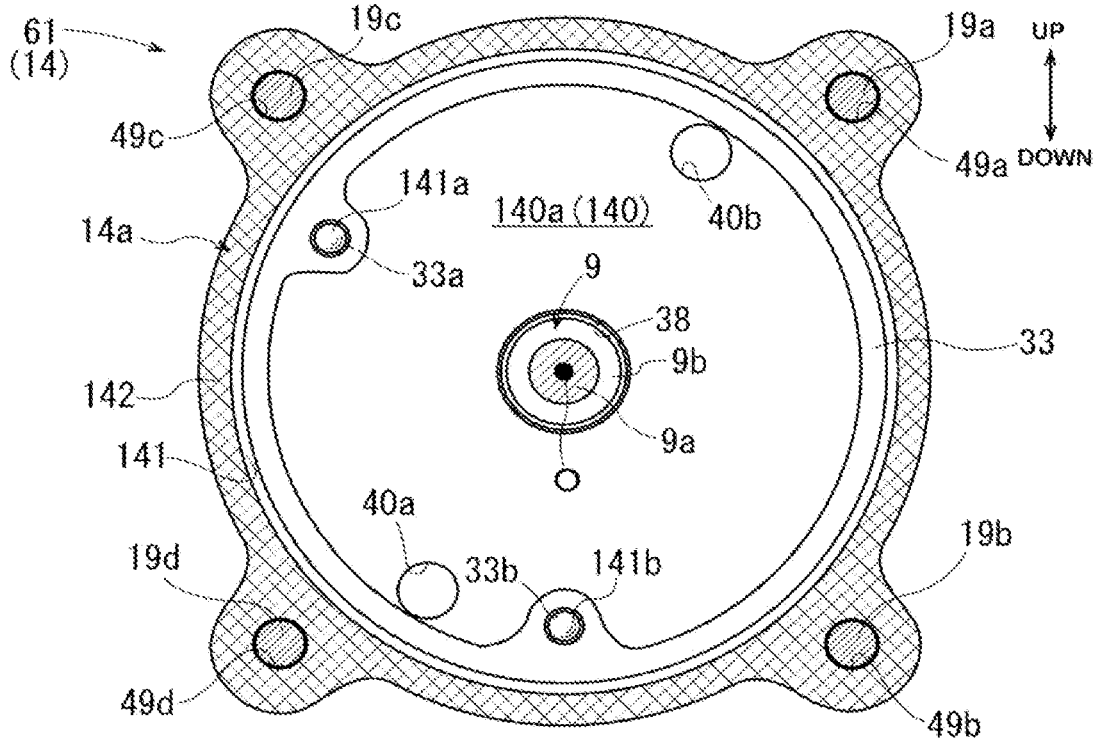
FIG. 6 is a front view of the turbo fluid machine according to the first embodiment, illustrating a contact portion and the like of the fourth housing being in contact with the third housing.
Figure 7:
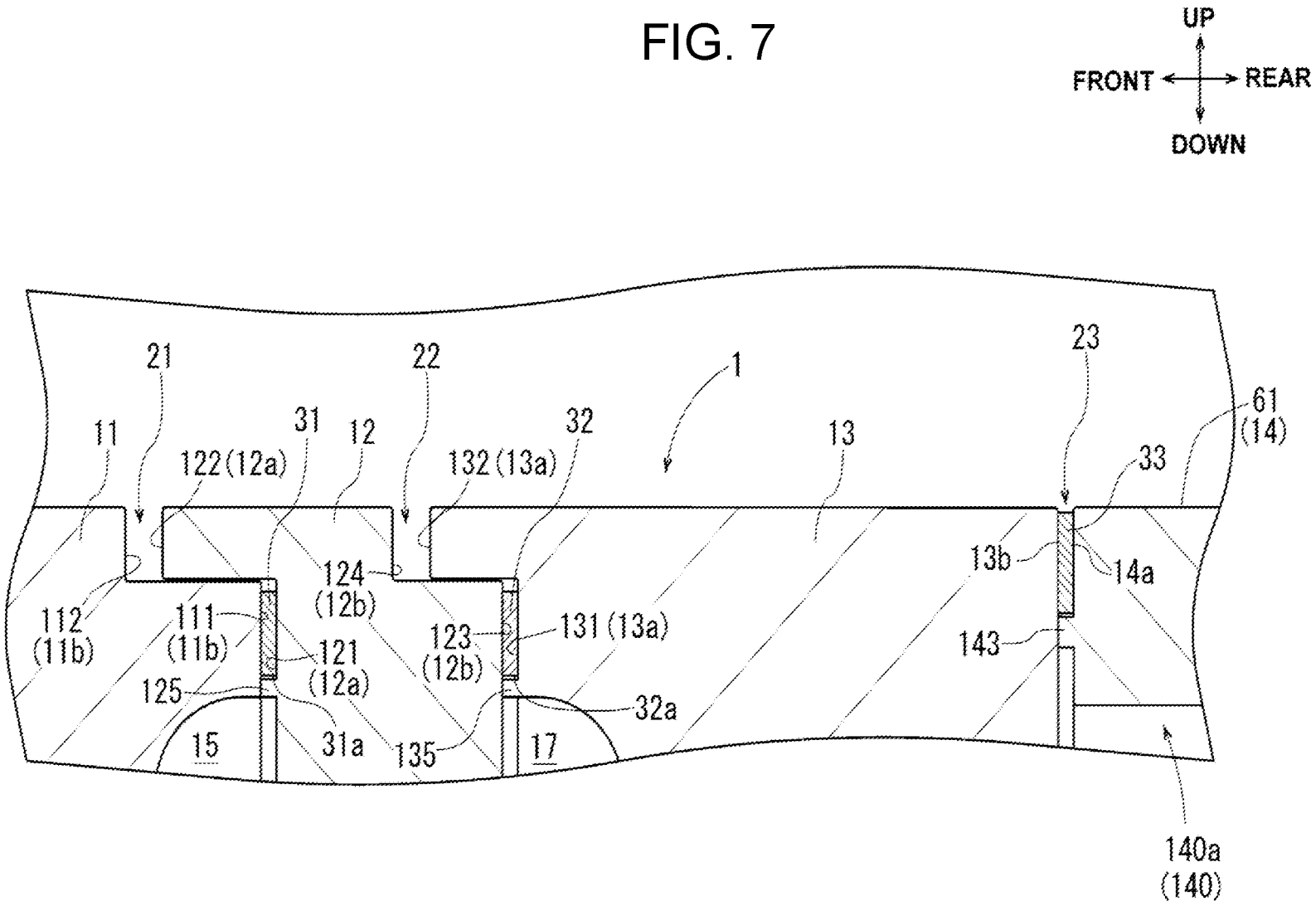
FIG. 7 is an enlarged cross-sectional view of a main part of a turbo fluid machine according to a second embodiment as with FIG. 2.

As illustrated in FIG. 4 and FIG. 6, the fourth housing 14 including the first to third blocks 61 to 63 has an insertion hole 49*a* into which the first fastening bolt 19*a* is inserted, an insertion hole 49*b* into which the second fastening bolt 19*b* is inserted, an insertion hole 49*c* into which the third fastening bolt 19*c* is inserted, and an insertion hole 49*d* into which the fourth fastening bolt 19*d* is inserted. The insertion holes 49*a* to 49*d* communicate with the insertion holes 43*a* to 43*d* of the third housing 13, respectively, and extend into the fourth housing 14 from the fourth front-side outer circumferential portion 142 of the fourth front end surface 14*a*. The first housing 11 and the second housing 12 each have an insertion hole (not illustrated) into which each of the first to fourth fastening bolts 19*a* to 19*d* is inserted.

As illustrated in FIG. 1, the third motor chamber 140*c* of the motor chamber 140 accommodates the electric motor 3. The electric motor 3 includes a stator 3*a* and a rotor 3*b*. The stator 3*a* extends in the front-rear direction to have a cylindrical shape, and is fixed to an inner wall of the fourth housing 14. The stator 3*a* is connected to a power supplier (not illustrated) provided outside the housing 1. The rotor 3*b* whose diameter is smaller than that of the stator 3*a* extends in the front-rear direction to have a cylindrical shape. The rotor 3*b* is disposed inside the stator 3*a*.

The first radial bearing 51 accommodated in the first accommodation portion 44 is positioned closer to a front part of the motor chamber 140 than the stator 3*a* of the electric motor 3 is.

The first impeller chamber 15 accommodates the first impeller 5. The first impeller 5 has a substantially conical shape and its diameter gradually increases from the front toward the rear. The second impeller chamber 17 accommodates the second impeller 7 disposed behind the first impeller 5 in the front-rear direction. The first impeller 5 and the second impeller 7 are symmetrical in the front-rear direction. That is, the second impeller 7 has a substantially conical shape and its diameter gradually reduces from the front toward the rear.

The drive shaft 9 has a cylindrical columnar shape extending in the front-rear direction and is disposed in the first to fourth housings 11 to 14 of the housing 1. The drive shaft 9 includes a small diameter portion 9*a* and a large diameter portion 9*b*. The small diameter portion 9*a* forms a front part of the drive shaft 9, and enters the second inlet 25 of the first housing 11, the first axial hole 27 of the second housing 12, the second axial hole 37 of the third housing 13, and the first motor chamber 140*a*.

A diameter of the small diameter portion 9*a* is smaller than that of each of the second inlet 25, the first axial hole 27, and the second axial hole 37. The small diameter portion 9*a* is press-fitted into the first impeller 5 and the second impeller 7. Thus, the small diameter portion 9*a* is fixed to the first impeller 5 and the second impeller 7.

The large diameter portion 9*b* is connected to a rear end of the small diameter portion 9*a* and extends rearward. As a result, the large diameter portion 9*b* forms a rear part of the drive shaft 9. The large diameter portion 9*b* is press-fitted into the rotor 3*b* and fixed to the rotor 3*b*. Thus, the drive shaft 9 connects the first impeller 5 and the second impeller 7, and the electric motor 3.

A front part of the large diameter portion 9*b* enters the third axial hole 38, the fourth axial hole 39, and the first accommodation portion 44, and is rotatably supported by the first radial bearing 51. A rear end of the large diameter portion 9*b* enters the second accommodation portion 45, and is rotatably supported by the second radial bearing 54.

The large diameter portion 9*b* is inserted into the first thrust bearing 52 and the second thrust bearing 53 inside the second motor chamber 140*b*. A support plate 91 is press-fitted into the large diameter portion 9*b*. The support plate 91 is disposed inside the second motor chamber 140*b*, and positioned between the first thrust bearing 52 and the second thrust bearing 53. As a result, the support plate 91 holds the first thrust bearing 52 at a position between the support plate 91 and the first bottom wall 61*a* of the first block 61, and holds the second thrust bearing 53 at a position between the support plate 91 and the second bottom wall 62*a* of the second block 62. Thus, the first thrust bearing 52 and the second thrust bearing 53 support thrust load applied to the drive shaft 9.

The drive shaft 9 is rotatable by the electric motor 3. Specifically, a drive shaft center of the drive shaft 9 is defined as a drive shaft center O, and the drive shaft 9 is rotatable around the drive shaft center O. The drive shaft 9 rotates around the drive shaft center O, so that the first impeller 5 rotates around the drive shaft center O inside the first impeller chamber 15. Similarly, the second impeller 7 rotates around the drive shaft center O inside the second impeller chamber 17. The drive shaft center O is parallel to the front-rear direction of the turbo fluid machine.

The first to third gaskets 31 to 33 illustrated in FIG. 1 and FIG. 2 are made of a metal plate member. A rubber layer (not illustrated) is provided on opposite surfaces of each of the first to third gaskets 31 to 33. The first gasket 31 is disposed in the second front-side main body portion 121, and has a round shape along the second front-side main body portion 121 of the second front end surface 12*a*. That is, the first gasket 31 is disposed on the second front end surface 12*a* on an inner circumferential side of the second front-side outer circumferential portion 122. As illustrated in FIG. 2, the first gasket 31 has a first through portion 31*a* which extends through the first gasket 31 in the front-rear direction. The first through portion 31*a* is formed along the first impeller chamber 15 (not illustrated in detail). The first to third gaskets 31 to 33 may be made of only the metal plate member.

As illustrated in FIG. 3 and FIG. 5, the second gasket 32 is formed into a round shape along the third front-side main body portion 131 of the third front end surface 13*a*. The second gasket 32 has a second through portion 32*a*, a first engagement hole 32*b*, and a second engagement hole 32*c*. The second through portion 32*a*, and the first engagement hole 32*b* and the second engagement hole 32*c* extend through the second gasket 32 in the front-rear direction. The second through portion 32*a* is formed along the second impeller chamber 17. The first engagement hole 32*b* and the second engagement hole 32*c* are formed into a round shape. In the second gasket 32, the first positioning protrusion 131*a* is positioned in the first engagement hole 32*b*, and the second positioning protrusion 131*b* is positioned inside the second engagement hole 32*c*. Thus, the second gasket 32 is positioned at the third front end surface 13*a*, specifically at the third front-side main body portion 131. As described above, the second gasket 32 is disposed on the third front end surface 13*a* on an inner circumferential side of the third front-side outer circumferential portion 132.

The second gasket 32 includes a bead 32*d* protruding forward, specifically, toward the second rear-side main body portion 123 of the second rear end surface 12*b*. The bead 32*d* surrounds a circumference of the second through portion 32*a*. Thus, the bead 32*d* surrounds the second impeller chamber 17 on its outer circumference. Although not illustrated, as with the second gasket 32, the first gasket 31 is positioned in the second front end surface 12*a*, and incudes a bead surrounding the first impeller chamber 15 on its outer circumference.

As illustrated in FIG. 4 and FIG. 6, the third gasket 33 is formed into an annular shape along the fourth front-side main body portion 141 of the fourth front end surface 14*a*. The third gasket 33 includes a third engagement hole 33*a* and a fourth engagement hole 33*b* extending through the third gasket 33 in the front-rear direction. As with the first and second engagement holes 32*b*, 32*c*, the third and fourth engagement holes 33*a*, 33*b* are each formed into a round shape. In the third gasket 33, the third positioning protrusion 141*a* is positioned inside the third engagement hole 33*a*, and the fourth positioning protrusion 141*b* is positioned inside the fourth engagement hole 33*b*. Thus, the third gasket 33 is positioned in the fourth front end surface 14*a*, specifically in the fourth front-side main body portion 141. That is, the third gasket 33 is disposed on an outer circumferential side of the motor chamber 140.

In the turbo fluid machine of the present embodiment, the first to fourth housings 11 to 14 and the first to third gaskets 31 to 33 are fastened to each other with the first to fourth fastening bolts 19*a* to 19*d*. As a result, as illustrated in FIG. 2, the first gasket 31 is disposed in the first division portion 21 and held by and between the first rear-side main body portion 111 and the second front-side main body portion 121. The second gasket 32 is disposed in the second division portion 22 and held by and between the second rear-side main body portion 123 and the third front-side main body portion 131. The third gasket 33 is disposed in the third division portion 23 and held by and between the third rear-side main body portion 133 and the fourth front-side main body portion 141.

As descried above, the first gasket 31 seals a gap between the first impeller chamber 15 and the outside of the housing 1. The second gasket 32 seals a gap between the second impeller chamber 17 and the outside of the housing 1. The third gasket 33 seals a gap between the motor chamber 140 and the outside of the housing 1. The motor chamber 140 communicates with the second impeller chamber 17 and the first impeller chamber 15 through the second axial hole 37 and the first axial hole 27. Thus, the third gasket 33 also seals a gap between the first and second impeller chambers 15, 17 and the outside of the housing 1.

In the turbo fluid machine of the present embodiment, the first rear-side outer circumferential portion 112 of the first rear end surface 11*b* is in contact with the second front-side outer circumferential portion 122 of the second front end surface 12*a* in the front-rear direction. The second rear-side outer circumferential portion 124 of the second rear end surface 12*b* is in contact with the third front-side outer circumferential portion 132 of the third front end surface 13*a* in the front-rear direction. The third rear-side outer circumferential portion 134 of the third rear end surface 13*b* is in contact with the fourth front-side outer circumferential portion 142 of the fourth front end surface 14*a* in the front-rear direction.

In the fourth housing 14, gaskets (not illustrated) are each disposed between the first block 61 and the second block 62 and between the second block 62 and the third block 63.

In the turbo fluid machine of the present embodiment, the power supplier supplies electric power to the electric motor 3 in FIG. 1 and the electric motor 3 is driven, so that the drive shaft 9 rotates around the drive shaft center O. Thus, the first impeller 5 rotates around the drive shaft center O inside the first impeller chamber 15, and the second impeller 7 rotates around the drive shaft center O inside the second impeller chamber 17.

The refrigerant gas is drawn into the motor chamber 140 from the first inlet 41 and drawn into the second impeller chamber 17 through the second axial hole 37. Then, the refrigerant gas drawn into the second impeller chamber 17 is compressed by the second impeller 7 and flows from an inner circumferential side toward an outer circumferential side of the second impeller chamber 17. Thus, the refrigerant gas compressed by the second impeller 7 is discharged from the first outlet 29 and flows through the piping 200.

Then, the refrigerant gas flowing through the piping 200 is drawn into the first impeller chamber 15 from the second inlet 25. Thus, the refrigerant gas is further compressed by the first impeller 5, flows from an inner circumferential side toward an outer circumferential side of the first impeller chamber 15, and is discharged to the outside of the housing 1 from the second outlet. As described above, in the turbo fluid machine of the present embodiment, the refrigerant gas is compressed in two steps by the second impeller 7 and the first impeller 5.

In the turbo fluid machine of the present embodiment, the first to third gaskets 31 to 33 are provided in the first to third division portions 21 to 23, respectively. The first gasket 31 seals the gap between the first impeller chamber 15 and the outside of the housing 1. The second gasket 32 seals the gap between the second impeller chamber 17 and the outside of the housing 1. The third gasket 33 seals the gaps between the first and second impeller chambers 15, 17 and the outside of the housing 1, and between the motor chamber 140 and the outside of the housing 1.

Thus, in the turbo fluid machine of the present embodiment, the first to third gaskets 31 to 33 are provided as above, so that the housing 1 including the first to fourth housings 11 to 14 is downsized in the radial direction of the housing 1, as compared with a case in which the O-ring seals the gap between the first impeller chamber 15 and the outside of the housing 1, the gap between the second impeller chamber 17 and the outside of the housing 1, and the gap between the motor chamber 140 and the outside of the housing 1.

Then, in the turbo fluid machine of the present embodiment, the refrigerant gas is compressed to a high pressure by the first impeller 5 and the second impeller 7, which increases the pressure inside the first impeller chamber 15 and the pressure inside the second impeller chamber 17. In this respect, in the turbo fluid machine of the present embodiment, since the first to third gaskets 31 to 33 are each made of metal, the first to third gaskets 31 to 33 have rigidity resistant to such pressure of the refrigerant gas inside the first impeller chamber 15 and the second impeller chamber 17. Therefore, in the turbo fluid machine of the present embodiment, the first to third gaskets 31 to 33 suitably seal the gap between the first impeller chamber 15 and the outside of the housing 1, the gap between the second impeller chamber 17 and the outside of the housing 1, and the gap between the motor chamber 140 and the outside of the housing 1.

In the turbo fluid machine of the present embodiment, since the first to third gaskets 31 to 33 are each made of metal, the first to third gaskets 31 to 33 are easily manufactured to reduce a manufacturing cost of the first to third gaskets 31 to 33. In addition, in the turbo fluid machine of the present embodiment, the first to fourth housing 11 to 14 are easily assembled with the first to third gaskets 31 to 33.

Then, in the turbo fluid machine of the present embodiment, the second front-side outer circumferential portion 122 of the second front end surface 12*a* is positioned on the outer circumference of the first gasket 31 and protrudes forward relative to the first gasket 31. Similarly, the third front-side outer circumferential portion 132 of the third front end surface 13*a* is positioned on the outer circumference of the second gasket 32 and protrudes forward relative to the second gasket 32. The fourth front-side outer circumferential portion 142 of the fourth front end surface 14*a* is positioned on the outer circumference of the third gasket 33 and protrudes forward relative to the third gasket 33.

Thus, the first to fourth housings 11 to 14 are fastened to each other with the first to fourth fastening bolts 19*a* to 19*d*, so that the second front-side outer circumferential portion 122 is in contact with the first rear-side outer circumferential portion 112 of the first rear end surface 11*b* on an outer circumferential side of the first gasket 31. As indicated with a crosshatch pattern of FIG. 5, the third front-side outer circumferential portion 132 is in contact with the second rear-side outer circumferential portion 124 of the second rear end surface 12*b* on an outer circumferential side of the second gasket 32. At this time, the entire third front-side outer circumferential portion 132 is in contact with the entire second rear-side outer circumferential portion 124. As indicated with a crosshatch pattern of FIG. 6, the fourth front-side outer circumferential portion 142 is in contact with the third rear-side outer circumferential portion 134 of the third rear end surface 13*b* on an outer circumferential side of the third gasket 33. At this time, the entire fourth front-side outer circumferential portion 142 is in contact with the entire third rear-side outer circumferential portion 134. The entire second front-side outer circumferential portion 122 is in contact with the entire first rear-side outer circumferential portion 112 (not illustrated).

As illustrated in FIG. 2, the second front-side outer circumferential portion 122 is in contact with the first rear-side outer circumferential portion 112 at a position in front of the first gasket 31. Similarly, the third front-side outer circumferential portion 132 is in contact with the second rear-side outer circumferential portion 124 at a position in front of the second gasket 32. The fourth front-side outer circumferential portion 142 is in contact with the third rear-side outer circumferential portion 134 at a position in front of the third gasket 33.

As described above, in the turbo fluid machine of the present embodiment, in the first housing 11 and the second housing 12, the first rear end surface 11*b* is in indirect contact with the second front end surface 12*a* with the first gasket 31 interposed between the first rear end surface 11*b* and the second front end surface 12*a*, and in direct contact with the second front end surface 12*a* on the outer circumferential side of the first gasket 31. Similarly, in the second housing 12 and the third housing 13, the second rear end surface 12*b* is in indirect contact with the third front end surface 13*a* with the second gasket 32 interposed between the second rear end surface 12*b* and the third front end surface 13*a*, and in direct contact with the third front end surface 13*a* on the outer circumferential side of the second gasket 32. In the third housing 13 and the fourth housing 14, the third rear end surface 13*b* is in indirect contact with the fourth front end surface 14*a* with the third gasket 33 interposed between the third rear end surface 13*b* and the fourth front end surface 14*a*, and in direct contact with the fourth front end surface 14*a* on the outer circumferential side of the third gasket 33.

In the turbo fluid machine of the present embodiment, as illustrated in FIG. 2, the second front-side outer circumferential portion 122 is in contact with the first rear-side outer circumferential portion 112, which suitably secures a clearance in which the first gasket 31 is disposed in the first division portion 21, specifically, at a position between the second front-side main body portion 121 and the first rear-side main body portion 111. Similarly, the third front-side outer circumferential portion 132 is in contact with the second rear-side outer circumferential portion 124, which suitably secures a clearance in which the second gasket 32 is disposed at a position between the third front-side main body portion 131 and the second rear-side main body portion 123. The fourth front-side outer circumferential portion 142 is in contact with the third rear-side outer circumferential portion 134, which suitably secures a clearance in which the third gasket 33 is disposed at a position between the fourth front-side main body portion 141 and the third rear-side main body portion 133.

Thus, in the turbo fluid machine of the present embodiment, the first gasket 31 is suitably in contact with the second front-side main body portion 121 and the first rear-side main body portion 111. The second gasket 32 is suitably in contact with the third front-side main body portion 131 and the second rear-side main body portion 123. The third gasket 33 is suitably in contact with the fourth front-side main body portion 141 and the third rear-side main body portion 133.

Therefore, in the turbo fluid machine of the first embodiment, it is possible to suitably prevent leakage of the refrigerant gas from the insides of the first impeller chamber 15 and the second impeller chamber 17 and the inside of the motor chamber 140 to the outside of the housing 1, and to achieve downsizing of the turbo fluid machine and reduction of the manufacturing cost.

In particular, in the turbo fluid machine of the present embodiment, the second front-side outer circumferential portion 122, the third front-side outer circumferential portion 132, and the fourth front-side outer circumferential portion 142 are in contact with the first rear-side outer circumferential portion 112, the second rear-side outer circumferential portion 124, and the third rear-side outer circumferential portion 134 on the outer circumferential sides of the first to third gaskets 31 to 33, respectively. Thus, in the turbo fluid machine of the present embodiment, the first to fourth housings 11 to 14 and the first to third gaskets 31 to 33 are easily assembled with each other.

In the turbo fluid machine of the present embodiment, the second front-side outer circumferential portion 122, the third front-side outer circumferential portion 132, and the fourth front-side outer circumferential portion 142 are in contact with the first rear-side outer circumferential portion 112, the second rear-side outer circumferential portion 124, and the third rear-side outer circumferential portion 134 at positions spaced forward from the first to third gaskets 31 to 33, respectively. Therefore, in the turbo fluid machine of the present embodiment, the second front-side outer circumferential portion 122, the third front-side outer circumferential portion 132, and the fourth front-side outer circumferential portion 142 are easily in contact with the first rear-side outer circumferential portion 112, the second rear-side outer circumferential portion 124, and the third rear-side outer circumferential portion 134, respectively.

Here, the first rear-side outer circumferential portion 112 is a part of the first rear end surface 11*b* recessed forward relative to the first rear-side main body portion 111 so as to correspond to the second front-side outer circumferential portion 122. Similarly, the second rear-side outer circumferential portion 124 is a part of the second rear end surface 12*b* recessed forward relative to the second rear-side main body portion 123 so as to correspond to the third front-side outer circumferential portion 132. The third rear-side outer circumferential portion 134 is a part of the third rear end surface 13*b* recessed forward relative to the third rear-side main body portion 133 so as to correspond to the fourth front-side outer circumferential portion 142. Thus, the first to third division portions 21 to 23 are each bent forward on the outer circumferential side thereof to have a stepped shape. As a result, in the turbo fluid machine of the present embodiment, it is easy to set a position relationship between the first housing 11 and the second housing 12, a position relationship between the second housing 12 and the third housing 13, and a position relationship between the third housing 13 and the fourth housing 14.

The first to third division portions 21 to 23 are each bent forward on the outer circumferential side thereof to have the stepped shape, which reduces inevitable leakage of the refrigerant gas occurring in the first to third division portions 21 to 23 as much as possible.

In addition, in the turbo fluid machine of the present embodiment, the bead 32*d* is formed at the second gasket 32. Thus, the bead 32*d* allows the second gasket 32 to be more reliably in contact with the second rear-side main body portion 123. The first gasket 31 is also configured as with the second gasket 32.

Second Embodiment

As illustrated in FIG. 7, in the turbo fluid machine of the second embodiment, a first inner contact portion 125 is formed relative to the second front-side main body portion 121 of the second front end surface 12*a*, and a second inner contact portion 135 is formed relative to the third front-side main body portion 131 of the third front end surface 13*a*.

The first inner contact portion 125 is disposed closer to an inner circumferential side of the first gasket 31 than the first through portion 31*a* is, and protrudes forward from the second front-side main body portion 121. The first inner contact portion 125 surrounds the first impeller chamber 15 along the first impeller chamber 15, which is not illustrated in detail. Thus, the first inner contact portion 125 forms an inner wall of the first impeller chamber 15.

Figure 8:
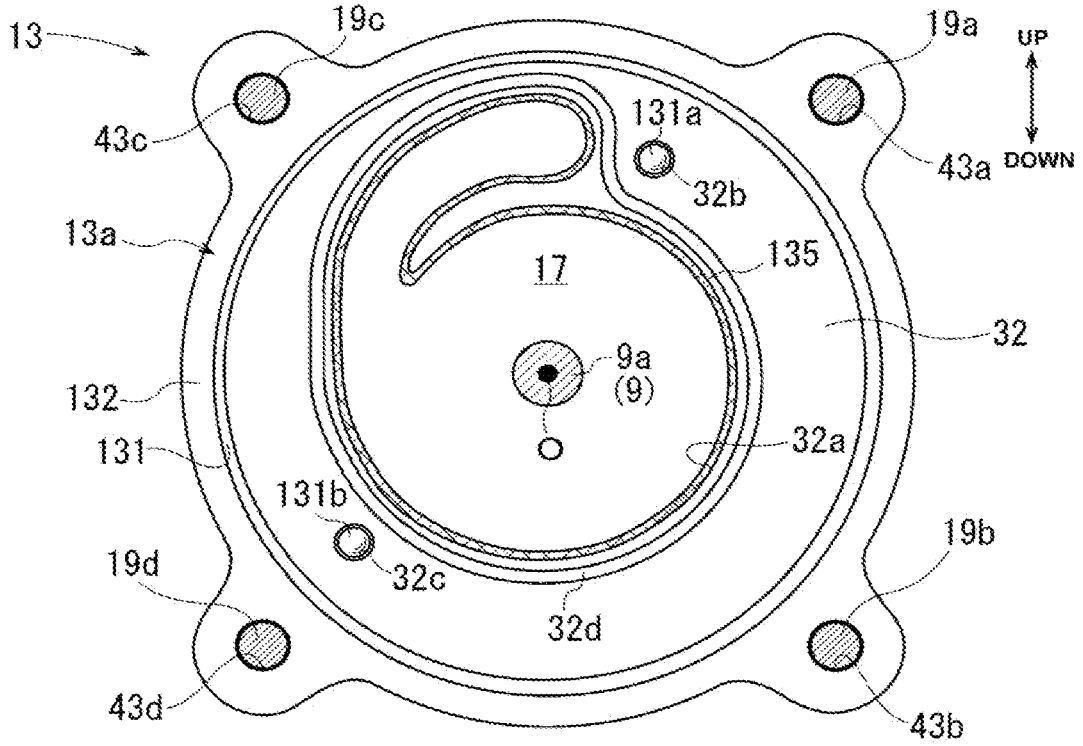
FIG. 8 is a front view of the turbo fluid machine according to the second embodiment as with FIG. 5.

As illustrated in FIG. 8, the second inner contact portion 135 is disposed closer to an inner circumferential side of the second gasket 32 than the second through portion 32*a* is, and protrudes forward from the third front-side main body portion 131. The second inner contact portion 135 surrounds the second impeller chamber 17 along the second impeller chamber 17. Thus, the second inner contact portion 135 forms an inner wall of the second impeller chamber 17. The bead 32*d* is disposed outside the second inner contact portion 135, and surrounds the second inner contact portion 135.

Figure 9:
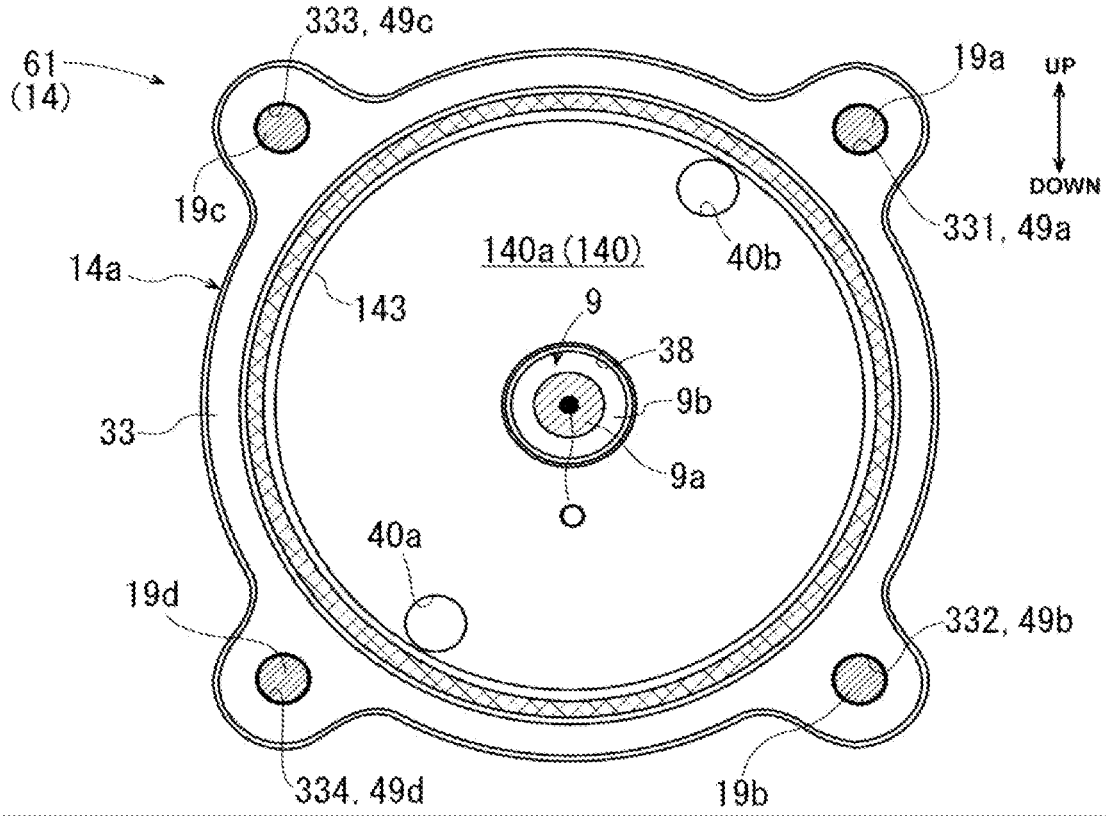
FIG. 9 is a front view of the turbo fluid machine according to the second embodiment as with FIG. 6.

As illustrated in FIG. 7, unlike the turbo fluid machine of the first embodiment, in the turbo fluid machine of the present embodiment, the third rear end surface 13*b* does not include the third rear-side main body portion 133 and the third rear-side outer circumferential portion 134. Similarly, the fourth front end surface 14*a* does not include the fourth front-side main body portion 141 and the fourth front-side outer circumferential portion 142. Then, in the turbo fluid machine of the present embodiment, as illustrated in FIG. 9, the third gasket 33 has an insertion hole 331 into which the first fastening bolt 19*a* is inserted, an insertion hole 332 into which the first fastening bolt 19*b* is inserted, an insertion hole 333 into which the first fastening bolt 19*c* is inserted, and an insertion hole 334 into which the fourth fastening bolt 19*d* is inserted.

In the turbo fluid machine of the present embodiment, a third inner contact portion 143 is formed relative to the fourth front end surface 14*a*. The third inner contact portion 143 is disposed on an inner circumferential side of the third gasket 33, and annularly protrudes forward from the fourth front-side main body portion 141. In the turbo fluid machine of the present embodiment, arrangements of components other than the third inner contact portion 143 are the same as those in the turbo fluid machine of the first embodiment. Thus, the components of the second embodiment corresponding to those of the first embodiment are designated by the same reference numerals and are not described in detail.

As with the turbo fluid machine of the first embodiment, in the turbo fluid machine of the present embodiment, in a state where the first to third gaskets 31 to 33 are disposed in the first to third division portions 21 to 23, respectively, the first to fourth housings 11 to 14 are fastened to each other with the first to fourth fastening bolts 19*a* to 19*d*. At this time, in the third gasket 33, the insertion holes 331 to 334 correspond to the insertion holes 49*a* to 49*d*, respectively. Then, the first to fourth fastening bolts 19*a* to 19*d* are inserted into the insertion holes 331 to 334 and the insertion holes 49*a* to 49*d*, so that the third gasket 33 is positioned in the fourth front end surface 14*a*. In this state, the third gasket 33 is held by and between the third rear end surface 13*b* and the fourth front end surface 14*a*.

As described above, as with the turbo fluid machine of the first embodiment, in the turbo fluid machine of the present embodiment, the first to third gaskets 31 to 33 seal the gap between the first impeller chamber 15 and the outside of the housing 1, the gap between the second impeller chamber 17 and the outside of the housing 1, and the gap between the motor chamber 140 and the outside of the housing 1.

As illustrated in FIG. 7, in the turbo fluid machine of the present embodiment, the first to fourth housings 11 to 14 are fastened to each other with the first to fourth fastening bolts 19*a* to 19*d*, so that the first inner contact portion 125 is in contact with the first rear-side main body portion 111 of the first rear end surface 11*b* on the inner circumferential side of the first gasket 31. As indicated with a crosshatch pattern of FIG. 8, the second inner contact portion 135 is in contact with the second rear-side main body portion 123 of the second rear end surface 12*b* on the inner circumferential side of the second gasket 32. At this time, the entire second inner contact portion 135 is in contact with the second rear-side main body portion 123. As described above, the second inner contact portion 135 is in contact with the second rear-side main body portion 123, so that the second impeller chamber 17 is formed by and between the second housing 12 and the third housing 13. Similarly, the first inner contact portion 125 is also configured as the second inner contact portion 135, which is not illustrated in detail.

As indicated with a crosshatch pattern of FIG. 9, the third inner contact portion 143 is in contact with the third rear end surface 13*b* on the inner circumferential side of the third gasket 33. At this time, the entire third inner contact portion 143 is contact with the third rear end surface 13*b*.

As described above, in the turbo fluid machine of the present embodiment, the first housing 11 and the second housing 12 are in indirect contact with each other with the first gasket 31 interposed between the first rear end surface 11*b* and the second front end surface 12*a*, and are in direct contact with each other on the inner circumferential side of the first gasket 31. Similarly, the second housing 12 and the third housing 13 are in indirect contact with each other with the second gasket 32 interposed between the second rear end surface 12*b* and the third front end surface 13*a*, and are in direct contact with each other on the inner circumferential side of the second gasket 32. The third housing 13 and the fourth housing 14 are in indirect contact with each other with the third gasket 33 interposed between the third rear end surface 13*b* and the fourth front end surface 14*a*, and are in direct contact with each other on the inner circumferential side of the third gasket 33.

As described above, in the turbo fluid machine of the present embodiment, the first inner contact portion 125 is in contact with the first rear-side main body portion 111, which suitably secures a clearance in which the first gasket 31 is disposed between the second front-side main body portion 121 and the first rear-side main body portion 111. Similarly, the second inner contact portion 135 is in contact with the second rear-side main body portion 123, which suitably secures a clearance in which the second gasket 32 is disposed between the third front-side main body portion 131 and the second rear-side main body portion 123. The third inner contact portion 143 is in contact with the third rear end surface 13*b*, which suitably secures a clearance in which the third gasket 33 is disposed between the fourth front end surface 14*a* and the third rear end surface 13*b*.

Here, in the turbo fluid machine of the present embodiment, when the clearance for the first gasket 31 is secured by the first inner contact portion 125 being in contact with the first rear-side main body portion 111, the second front-side outer circumferential portion 122 need not be in contact with the first rear-side outer circumferential portion 112. Similarly, in the turbo fluid machine of the present embodiment, when the clearance for the second gasket 32 is secured by the second inner contact portion 135 being in contact with the second rear-side main body portion 123, the third front-side outer circumferential portion 132 need not be in contact with the second rear-side outer circumferential portion 124.

Furthermore, in the turbo fluid machine of the present embodiment, the first inner contact portion 125 is in contact with the first rear-side main body portion 111 on the inner circumferential side of the first gasket 31, the second inner contact portion 135 is in contact with the second rear-side main body portion 123 on the inner circumferential side of the second gasket 32, and the third inner contact portion 143 is in contact with the third rear end surface 13*b* on the inner circumferential side of the third gasket 33. Thus, in the turbo fluid machine of the present embodiment, the first to fourth housings 11 to 14 and the first to third gaskets 31 to 33 are easily assembled to each other.

As illustrated in FIG. 8, the second inner contact portion 135 is formed along a shape of the second impeller chamber 17. Thus, in the turbo fluid machine of the present embodiment, the second inner contact portion 135 seals the gap between the second impeller chamber 17 and the outside of the housing 1 at a position closer to the second impeller chamber 17 than the bead 32*d* of the second gasket 32 is. The first inner contact portion 125 seals the gap between the first impeller chamber 15 and the outside of the housing 1, which is not illustrated in detail. Other actions of the turbo fluid machine of the present embodiment are the same as those of the turbo fluid machine of the first embodiment.

Modification

Figure 10:
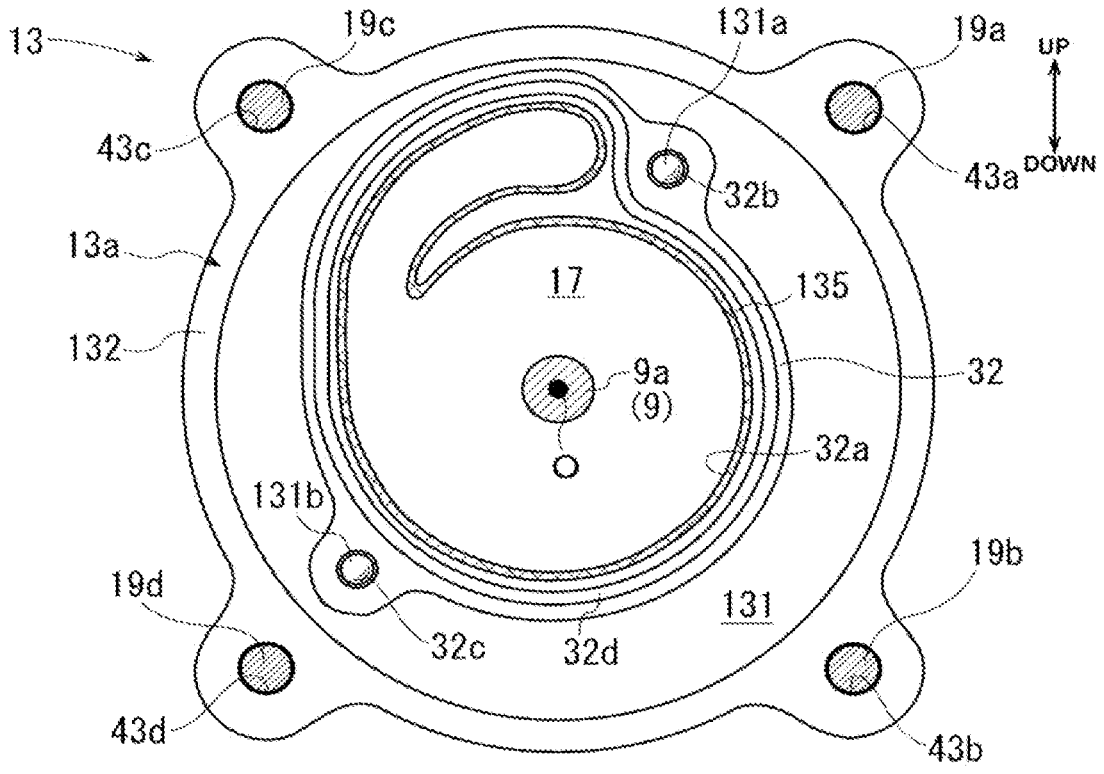
FIG. 10 is a front view of a turbo fluid machine according to a modification as with FIG. 5.

As illustrated in FIG. 10, in the turbo fluid machine of a modification, the second gasket 32 has a substantially elliptical shape for fitting the second impeller chamber 17 without having a round shape along the third front-side main body portion 131. Arrangements of components other than the second gasket 32 are the same as those in the turbo fluid machine of the second embodiment.

In the turbo fluid machine of the present modification, the second gasket 32 can be downsized as compared with that of the turbo fluid machine of each of the first and second embodiments. Thus, in the turbo fluid machine of the present modification, a manufacturing cost of the turbo fluid machine can be reduced. Other actions of the turbo fluid machine of the present modification are the same as those of the turbo fluid machine of each of the first and second embodiments.

As described above, although the present disclosure is described in accordance with the first and second embodiments and the modification, the present disclosure is not limited by the first and second embodiments and the modification and may be appropriately changed without departing from the scope of the disclosure.

For example, the first and second embodiments and the modification may be appropriately combined with each other to form the turbo fluid machine. Thus, the first rear end surface 11*b* may be in direct contact with the second front end surface 12*a* on the outer circumferential side of the first gasket 31. The second rear end surface 12*b* may be in direct contact with the third front end surface 13*a* on the outer circumferential side of the second gasket 32. The third rear end surface 13*b* may be in direct contact with the fourth front end surface 14*a* on the inner circumferential side of the third gasket 33.

In the turbo fluid machine of each of the first embodiment and the modification, the second front-side outer circumferential portion 122, the third front-side outer circumferential portion 132, and the fourth front-side outer circumferential portion 142 need not protrude forward. The first rear-side outer circumferential portion 112, the second rear-side outer circumferential portion 124, and the third rear-side outer circumferential portion 134 need not be recessed forward. The turbo fluid machine of the second embodiment is the same as that of each of the first embodiment and the modification.

The turbo fluid machine may be formed without the second impeller 7 and the second impeller chamber 17.

In the turbo fluid machine of each of the second embodiment and the modification, in a state where the first inner contact portion 125 is in contact with the first rear-side main body portion 111, the second front-side outer circumferential portion 122 may be in contact with the first rear-side outer circumferential portion 112. Similarly, in a state where the second inner contact portion 135 is in contact with the second rear-side main body portion 123, the third front-side outer circumferential portion 132 may be in contact with the second rear-side outer circumferential portion 124.

In the turbo fluid machine of each of the second embodiment and the modification, the first inner contact portion 125 may protrude rearward relative to the first rear-side main body portion 111. Similarly, the second inner contact portion 135 may protrude rearward relative to the second rear-side main body portion 123, and the third inner contact portion 143 may protrude rearward relative to the third rear end surface 13*b*.

A configuration of the second gasket 32 in the turbo fluid machine of the modification may be applied to the first gasket 31.

In the turbo fluid machine of each of the first and second embodiments and the modification, although the first and second impellers 5, 7 compress the refrigerant gas as fluid, the first and second impellers 5, 7 may compress fluid other than the refrigerant gas. Examples of the fluid other than the refrigerant gas include air and hydrogen for supplying a fuel cell.

INDUSTRIAL APPLICABILITY

The present disclosure is applicable to a vehicle air conditioner and the like.

What is claimed is:

1. A turbo fluid machine comprising:

a housing including an impeller chamber and a motor chamber accommodating an electric motor;

an impeller that is accommodated in the impeller chamber and compresses fluid by the electric motor being rotated;

a drive shaft that is accommodated in the housing and extends in an axial direction of the drive shaft to connect the impeller and the electric motor; and a gasket that is made of a metal plate member and seals between the impeller chamber and an outside of the housing, wherein the housing includes a first housing and a second housing that form the impeller chamber, the first housing and the second housing are arranged in the axial direction, the gasket is disposed between the first housing and the second housing in the axial direction, the first housing and the second housing are in contact with each other in the axial direction on at least one of an outer circumferential side and an inner circumferential side of the gasket, the gasket is held by, and between, an axially end surface of the first housing and an axially end surface of the second housing in the axial direction, and the first housing and the second housing are in contact with each other only on the outer circumferential side of the gasket.

2. The turbo fluid machine according to claim 1, wherein the first housing and the second housing are in contact with each other at a position spaced from the gasket in the axial direction.

3. The turbo fluid machine according to claim 1, wherein the impeller chamber includes:

a first impeller chamber formed by the first housing and the second housing; and a second impeller chamber that is disposed between the first impeller chamber and the motor chamber in the axial direction and communicates with the first impeller chamber, the housing further includes a third housing, the second impeller chamber is formed by the third housing and the second housing, the second housing and the third housing are arranged in the axial direction, the gasket includes:

a first gasket that is disposed between the first housing and the second housing in the axial direction and seals between the first impeller chamber and the outside of the housing; and a second gasket that is disposed between the second housing and the third housing in the axial direction and seals between the second impeller chamber and the outside of the housing, and the second housing and the third housing are in contact with each other in the axial direction on at least one of an outer circumferential side and an inner circumferential side of the second gasket.

4. The turbo fluid machine according to claim 3, wherein the first housing and the second housing are in contact with each other only on the outer circumferential side or the inner circumferential side of the first gasket, and the second housing and the third housing are in contact with each other only on the outer circumferential side or the inner circumferential side of the second gasket.

5. The turbo fluid machine according to claim 3, wherein the housing further includes a fourth housing, the third housing and the fourth housing form the motor chamber, the third housing and the fourth housing are arranged in the axial direction, the gasket further includes a third gasket that is disposed between the third housing and the fourth housing in the axial direction and seals between the second impeller chamber and the outside of the housing and between the motor chamber and the outside of the housing, and the third housing and the fourth housing are in contact with each other in the axial direction on at least one of an outer circumferential side and an inner circumferential side of the third gasket.

* * * * *